US008052137B2

(12) United States Patent
Chung et al.

(10) Patent No.: US 8,052,137 B2
(45) Date of Patent: Nov. 8, 2011

(54) SHEET STOPPING MECHANISM AND AUTOMATIC DOCUMENT FEEDER HAVING SUCH SHEET STOPPING MECHANISM

(75) Inventors: Ming-Chieh Chung, Taoyuan Hsien (TW); Ming-Hung Chung, Taoyuan Hsien (TW)

(73) Assignee: Teco Image System Co., Ltd., Taoyuan Hsien (TW)

( * ) Notice: Subject to any disclaimer, the term of this patent is extended or adjusted under 35 U.S.C. 154(b) by 133 days.

(21) Appl. No.: 12/503,252

(22) Filed: Jul. 15, 2009

(65) Prior Publication Data

US 2010/0308528 A1 Dec. 9, 2010

(30) Foreign Application Priority Data

Jun. 5, 2009 (TW) ..... 98118821 A

(51) Int. Cl.
*B65H 3/06* (2006.01)
*B65H 3/52* (2006.01)

(52) U.S. Cl. ..... 271/117; 271/121; 271/118

(58) Field of Classification Search ..... 271/117, 271/118, 122, 121
See application file for complete search history.

(56) References Cited

U.S. PATENT DOCUMENTS

| | | | | |
|---|---|---|---|---|
| 6,991,227 | B2 * | 1/2006 | Kim | 271/10.12 |
| 7,255,339 | B2 * | 8/2007 | Hung et al. | 271/122 |
| 7,516,953 | B2 * | 4/2009 | Lee | 271/117 |
| 7,530,563 | B2 * | 5/2009 | Kuo | 271/124 |
| 7,753,363 | B2 * | 7/2010 | Liu et al. | 271/121 |
| 7,837,188 | B2 * | 11/2010 | Lee et al. | 271/117 |
| 2010/0259801 | A1 * | 10/2010 | Cheng | 358/498 |

FOREIGN PATENT DOCUMENTS

JP 06072581 A * 3/1994

* cited by examiner

*Primary Examiner* — Stefanos Karmis
*Assistant Examiner* — Luis A Gonzalez

(57) ABSTRACT

A sheet stopping mechanism includes a guiding element, a sheet stopping element and a guiding slot. The guiding element includes a sheathing part and an extension arm. The sheathing part is sheathed around an axle of the sheet pick-up roller. The sheet stopping element includes a stopping part, a protrusion part and a contact part. The extension arm of the guiding element is upwardly sustained against at the contact part of the sheet stopping element. The protrusion part of the sheet stopping element is accommodated within the guiding slot. When the sheet pick-up roller is moved toward a sheet input tray, the guiding element is uplifted. As a result, the protrusion part of the sheet stopping element is shifted and rotated in the guiding slot, and a front edge of the paper sheet is no longer hindered by the stopping part of the sheet stopping element.

20 Claims, 4 Drawing Sheets

SHEET STOPPING MECHANISM AND AUTOMATIC DOCUMENT FEEDER HAVING SUCH SHEET STOPPING MECHANISM

CLAIM OF PRIORITY

This application claims priority to Taiwanese Patent Application No. 098118821 filed on Jun. 5, 2009.

FIELD OF THE INVENTION

The present invention relates to a sheet stopping mechanism, and more particularly to a sheet stopping mechanism of an automatic document feeder.

BACKGROUND OF THE INVENTION

With increasing industrial development, digitalized office technologies have experienced great growth and are now rapidly gaining in popularity. For example, a diversity of office machines such as copy machines, printers, fax machines and scanners (also referred as single-function peripherals) are utilized to achieve various purposes. The diverse office machines, however, occupy lots of space. Nowadays, a multifunction peripheral having multiple functions in one structural unit, for example the functions of a printer, a scanner, a fax machine and/or a copy machine, is thus developed. As a consequence, the processing capability of the multifunction peripheral is increased and the operative space thereof is reduced.

For successively and continuously feeding many paper sheets, the single-function peripheral or the multifunction peripheral usually has an automatic document feeder (ADF). After a stack of paper sheets to be scanned are placed on the sheet feeding tray, the sheet-feeding mechanism of the auto document feeder will successively fed the paper sheets into the inner portion of the office machine so as to implement associated operations such as scanning, faxing, scanning operations and the like. The automatic document feeder has a sheet separating device for separating only a single paper sheet from the stack of paper sheets, so that a single paper sheet is allowed to be fed into the inner portion of the office machine at each time. In addition, the automatic document feeder has a sheet stopping mechanism. The front edges of the paper sheets are stopped by the sheet stopping mechanism from being transported into an entrance of a sheet-guiding path before the sheet-feeding operation is done.

FIG. 1 is a schematic view illustrating a sheet stopping mechanism of a conventional automatic document feeder. The sheet stopping mechanism comprises a restraining part 11 and a stopping part 12. By restraining rotation of the stopping part 12, the front edges of the paper sheets 13 are hindered by the lower end 121 of the stopping part 12 in order to achieving the sheet stopping purpose. For feeding the paper sheet into the entrance of the sheet-guiding path, the restraining part 11 is rotated with respect to the axle center 122 by a specified angle. Upon rotation of the restraining part 11, the lower end 121 of the stopping part 12 is ascended and thus the paper sheet is allowed to feed into the entrance of the sheet-guiding path. After the sheet-feeding operation is completed, the stopping part 12 returns to its original position due to the weight thereof.

The sheet stopping mechanism of the conventional automatic document feeder, however, still has some drawbacks. For example, the upper cover needs to be opened if the automatic document feeder is suffered from a breakdown. During the upper cover is closed, the paper sheets are possibly pierced through. Since the stopping part is lowered to a sheet-stopping position according to the weight of the stopping part after the sheet-feeding operation is completed, the weight of the stopping part should be elaborately designed and controlled. Moreover, if the stopping part has a feathering edge resulting from the fabricating process, the stopping part fails to be normally operated.

Therefore, there is a need of providing an improved sheet stopping mechanism so as to obviate the drawbacks encountered from the prior art.

SUMMARY OF THE INVENTION

It is an object of the present invention to provide sheet stopping mechanism for avoiding the problems of piercing through the paper sheets and resulting in the feathering edge.

In accordance with an aspect of the present invention, there is provided a sheet stopping mechanism of an automatic document feeder. The automatic document feeder comprising a sheet input tray and a sheet pick-up roller. A paper sheet is placed on the sheet input tray. The sheet stopping mechanism includes a guiding element, a sheet stopping element and a guiding slot. The guiding element includes a sheathing part and an extension arm. The sheathing part is sheathed around an axle of the sheet pick-up roller. The sheet stopping element includes a stopping part, a protrusion part and a contact part. The extension arm of the guiding element is upwardly sustained against at the contact part of the sheet stopping element. The protrusion part of the sheet stopping element is accommodated within the guiding slot. When the sheet pick-up roller is moved toward the sheet input tray, the guiding element is uplifted through the transmission of the sheathing part and the sheet pick-up roller. As a result, the protrusion part of the sheet stopping element is shifted and rotated in the guiding slot, and a front edge of the paper sheet is no longer hindered by the stopping part of the sheet stopping element but permitted to be transported into a sheet-guiding path.

In accordance with another aspect of the present invention, there is provided an automatic document feeder. The automatic document feeder includes a sheet input tray, a sheet pick-up roller and a sheet stopping mechanism. The sheet input tray is used for placing thereon at least one paper sheet. The sheet pick-up roller is used for transporting the paper sheet that is placed on the sheet input tray. The sheet stopping mechanism is used for selectively hindering the paper sheet from being transported into a sheet-guiding path or allowing the paper sheet to be transported into the sheet-guiding path by the sheet pick-up roller. The sheet stopping mechanism includes a guiding element, a sheet stopping element and a guiding slot. The guiding element includes a sheathing part and an extension arm. The sheathing part is sheathed around an axle of the sheet pick-up roller. The sheet stopping element includes a stopping part, a protrusion part and a contact part. The extension arm of the guiding element is upwardly sustained against at the contact part of the sheet stopping element. The protrusion part of the sheet stopping element is accommodated within the guiding slot. When the sheet pick-up roller is moved toward the sheet input tray, the guiding element is uplifted through the transmission of the sheathing part and the sheet pick-up roller. As a result, the protrusion part of the sheet stopping element is shifted and rotated in the guiding slot, and a front edge of the paper sheet is no longer hindered by the stopping part of the sheet stopping element but permitted to be transported into a sheet-guiding path.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The present invention provides a sheet stopping mechanism of an automatic document feeder for use with an office machine. An example of the office machine includes but is not limited to a printer, a scanner, a fax machine, a copy machine or a multifunction peripheral.

Figure 1:
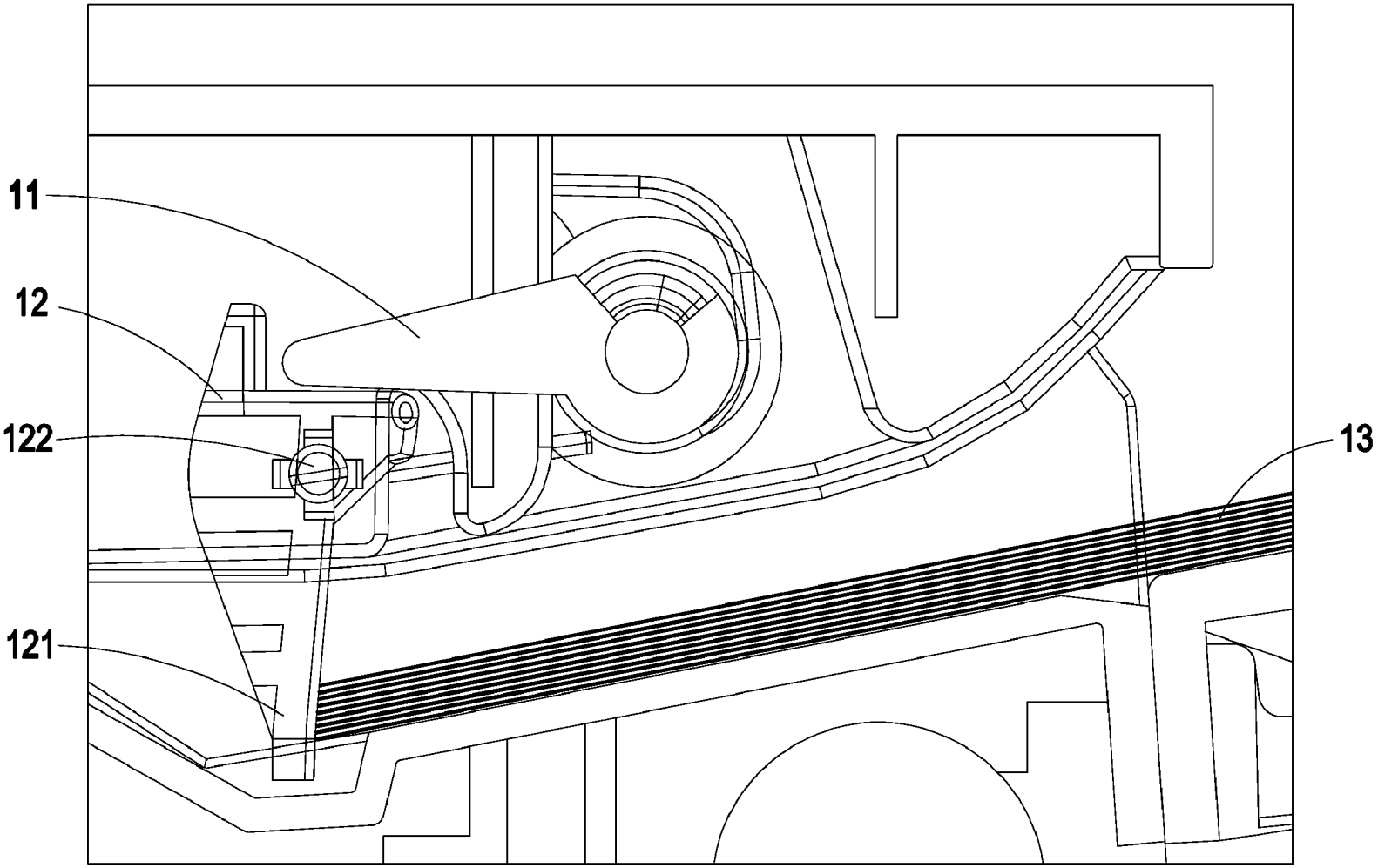
FIG. 1 PRIOR ART
FIG. 1 is a schematic view illustrating a sheet stopping mechanism of a conventional automatic document feeder.
Figure 2:
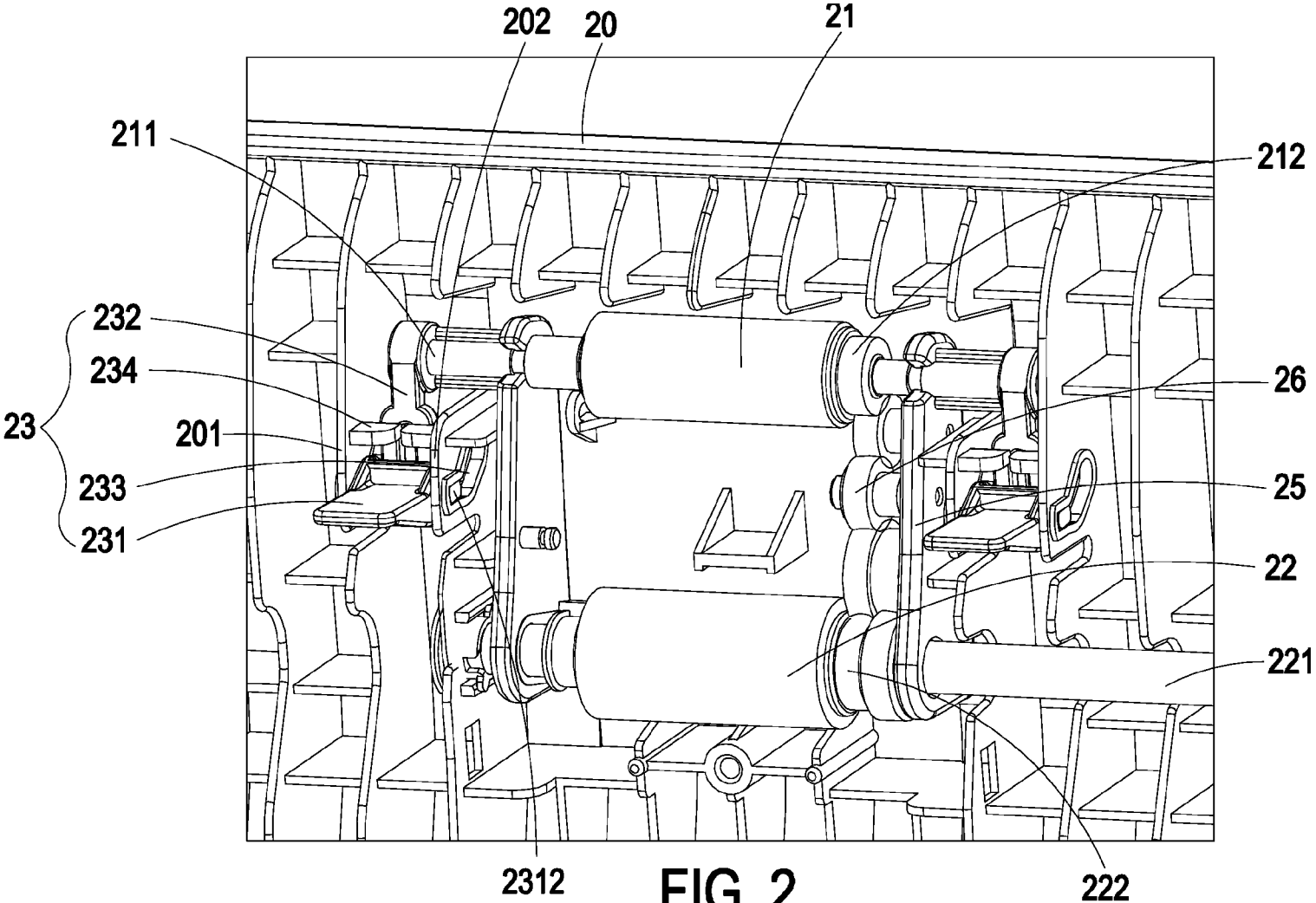
FIG. 2 is a schematic view partially illustrating the interior portion and an upper cover of an automatic document feeder according to an embodiment of the present invention.
Figure 3:
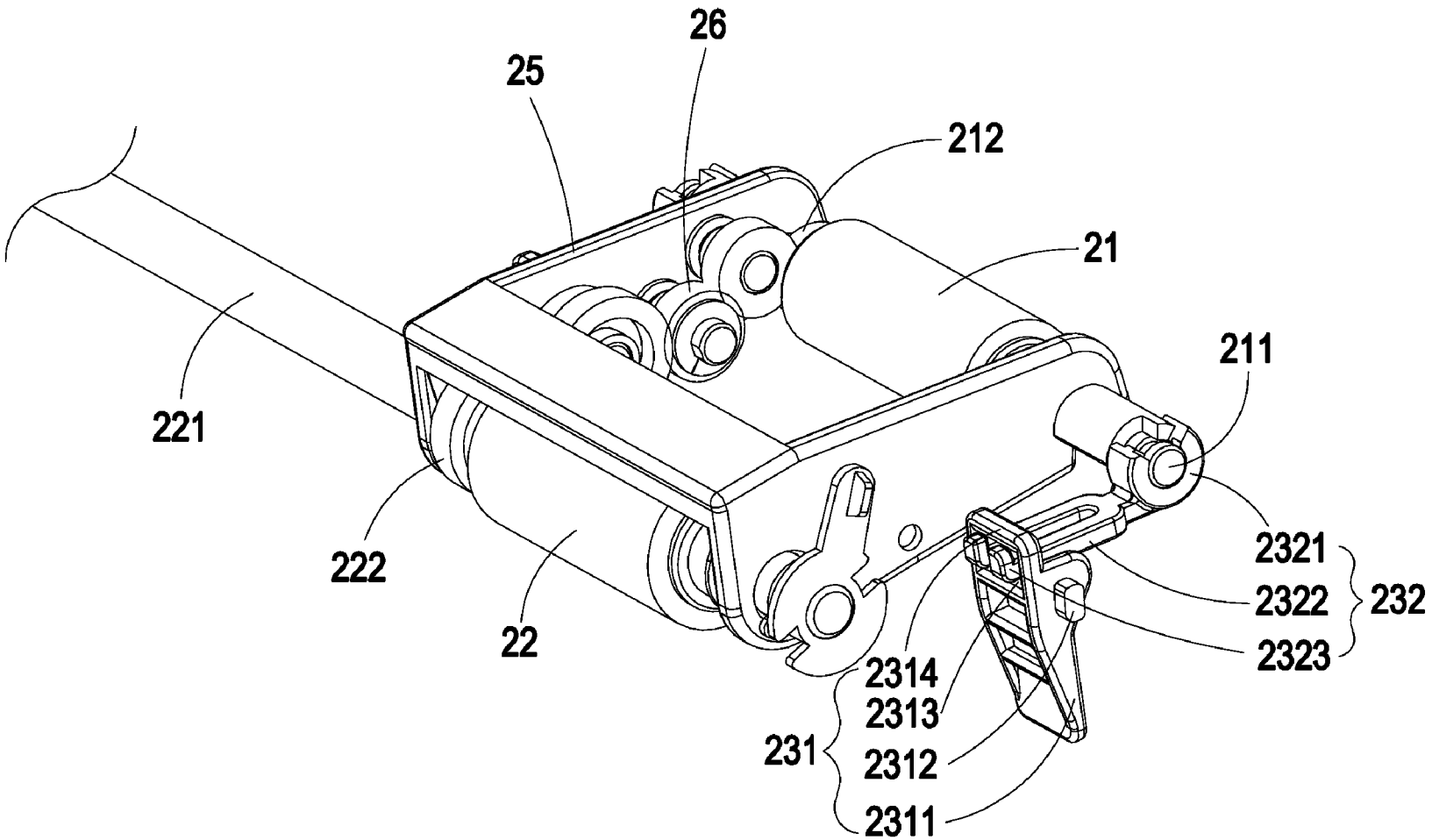
FIG. 3 is a schematic view partially illustrating the interior portion of the automatic document feeder of FIG. 2, in which the upper cover is not shown.
Figure 4A:
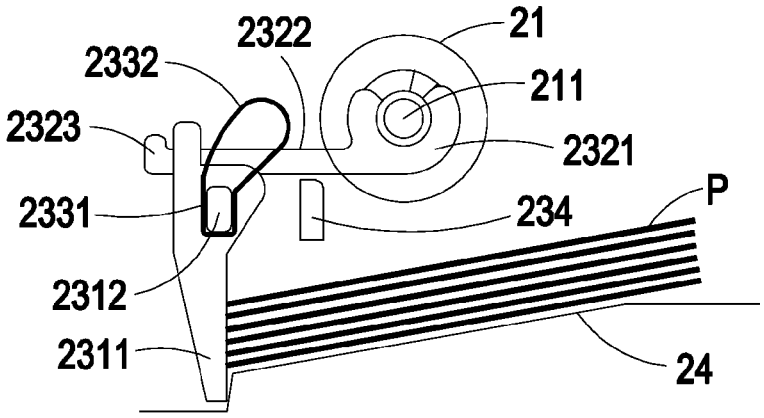
FIGS. 4A, 4B and 4C are schematic views illustrating operations of the sheet stopping mechanism of the present invention.
Figure 4B:
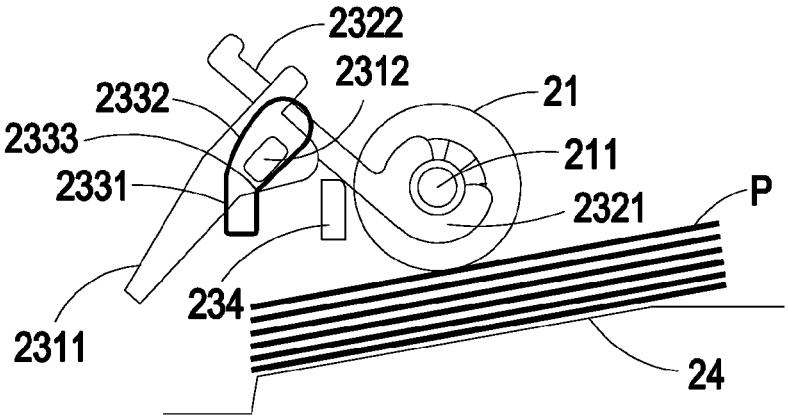
Figure 4C:
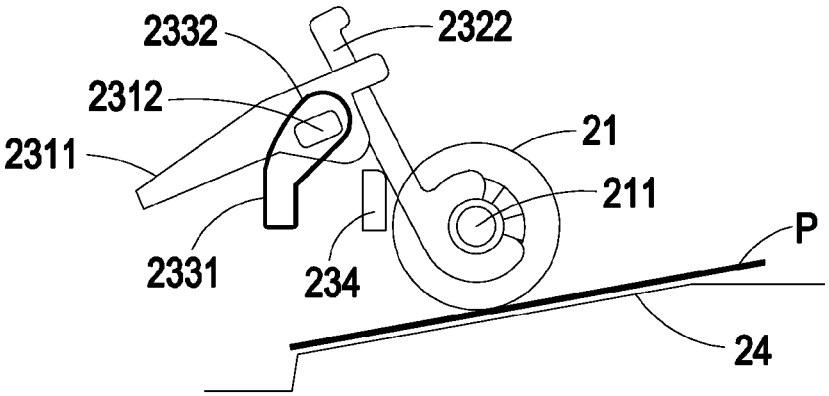

FIG. 2 is a schematic view partially illustrating the interior portion and an upper cover of an automatic document feeder according to an embodiment of the present invention. FIG. 3 is a schematic view partially illustrating the interior portion of the automatic document feeder of FIG. 2, in which the upper cover is not shown. FIGS. 4A, 4B and 4C are schematic views illustrating operations of the sheet stopping mechanism of the present invention.

Please refer to FIGS. 2, 3 and FIGS. 4A~4C. The automatic document feeder 2 comprises an upper cover 20, a sheet pick-up roller 21, a sheet separating roller 22 and a sheet stopping mechanism 23. The sheet pick-up roller 21, the sheet separating roller 22 and the sheet stopping mechanism 23 are mounted on the upper cover 20. In cooperation of the sheet pick-up roller 21, the sheet separating roller 22 and the sheet stopping mechanism 23, the paper sheets P (e.g. original scripts) that are placed on a sheet input tray 24 (see FIG. 4) are successively fed into a sheet-guiding path in order to be subject to an image processing operation.

The axle 221 of the sheet separating roller 22 is directly or indirectly connected to the driving device (not shown), so that the sheet separating roller 22 is driven to rotate by the driving device. In addition, a sheet pick-up arm 25 is arranged between the sheet separating roller 22 and the sheet pick-up roller 21. The sheet pick-up arm 25 is connected to the sheet separating roller 22 and the sheet pick-up roller 21. With the axle 221 of the sheet separating roller 22 serving as a rotating shaft, the sheet pick-up arm 25 is driven by the sheet separating roller 22 or the driving device to rotate such that the sheet pick-up arm 25 is moved to be close to or distant from the sheet input tray 24. In some embodiment, the axle 211 of the sheet pick-up roller 21 is sheathed by a first gear 212, the axle 221 of the sheet separating roller 22 is sheathed by a second gear 222, and a transmission gear set 26 is arranged between the sheet pick-up roller 21 and the sheet separating roller 22. The transmission gear set 26 is engaged with the first gear 212 and the second gear 222, so that the sheet pick-up roller 21 is rotated with the sheet separating roller 22. In a case that the sheet pick-up roller 21 upon rotation is contacted with the paper sheet P, the paper sheet P is fed into the sheet-guiding path. In some embodiments, the transmission gear set 26 is replaced by a transmission belt (not shown).

The sheet stopping mechanism 23 is arranged at the entrance of the sheet-guiding path. In a case that a sheet-feeding instruction is received, the uppermost paper sheet is separated from the stack of paper sheets P and transported into the entrance of the sheet-guiding path without being stopped by the sheet stopping mechanism 23. Whereas, in a case that no sheet-feeding instruction is received, the paper sheets P on the paper input tray 24 are hindered by the sheet stopping mechanism 23 from being transported into the entrance of the sheet-guiding path.

Please refer to FIGS. 2 and 3 again. The sheet stopping mechanism 23 comprises a sheet stopping element 231, a guiding element 232, two guiding slots 233 and a sustaining element 234. In a case that no sheet-feeding instruction is received, the front edges of the paper sheets P that are stacked on the paper input tray 24 are hindered by the sheet stopping element 231 from being transported into the entrance of the sheet-guiding path. An end of the guiding element 232 is sheathed around the axle 211 of the sheet pick-up roller 21. The other end of the guiding element 232 is sustained against the sheet stopping element 231. When the sheet pick-up roller 21 is moved toward the paper input tray 24, the sheet stopping element 231 is guided by the guiding element 232 to be shifted and rotated along the guiding slots 233, so that the front edge of the paper sheet is no longer hindered by the sheet stopping element 231 and the paper sheet is allowed to be fed into the entrance of the sheet-guiding path. Upon rotation of the guiding element 232, the sustaining element 234 is served as a fulcrum.

As shown in FIG. 3, the sheet stopping element 231 comprises a stopping part 2311, two protrusion parts 2312, a perforation 2313 and a contact part 2314. The stopping part 2311 is disposed at the lower end of the sheet stopping element 231 for hindering the front edges of the paper sheet if no sheet-feeding instruction is received. The protrusion parts 2312 are respectively disposed on two opposite sides of the sheet stopping element 231 and inserted into corresponding guiding slots 233 (see FIG. 2) for limiting movement of the sheet stopping element 231. The perforation 2313 is formed near the upper end of the sheet stopping element 231. The contact part 2314 is substantially a horizontal rod arranged at the upper end of the sheet stopping element 231. Moreover, the guiding element 232 comprises a sheathing part 2321, an extension arm 2322 and a confining part 2323. The sheathing part 2321 is sheathed around the axle 211 of the sheet pick-up roller 21. The extension arm 2322 has a first end connected to the sheathing part 2321 and a second end penetrating through the perforation 2313 of the sheet stopping element 231. The extension arm 2322 is substantially extended in the sheet-feeding direction. In addition, the confining part 2323 is formed at the second end of the extension arm 2322 for preventing the contact part 2314 of the sheet stopping element 231 from being detached from the extension arm 2322.

Please refer to FIG. 2 again. Several partition plates are protruded from the inner surface of the upper cover 20. In addition, the sheet stopping element 231 is arranged between two adjacent partition plates 201 and 202. Corresponding to the protrusion parts 2312, the two guiding slots 233 are respectively formed in the partition plates 201 and 202. The sustaining element 234 is arranged under the guiding element 232. In an embodiment, the sustaining element 234 includes two slabs, which are extended from the partition plates 201 and 202 and face each other.

As shown in FIGS. 2 and 4. The two guiding slots 233 are symmetrically arranged on bilateral sides of the sheet stopping element 231. Each of the guiding slots 233 is a profiled slot. In addition, the guiding slot 233 comprises a linear part 2331 and a curved part 2332. The linear part 2331 is substantially perpendicular to the horizontal plane. The width of the linear part 2331 is slightly larger than the width of the protrusion part 2312 of the sheet stopping element 231. The curved part 2332 is in communication with the linear part 2331 and bent toward the sheet pick-up roller 21. The width of the curved part 2332 is larger than the width of the linear part 2331 such that the protrusion part 2312 of the sheet stopping element 231 is permitted to be shifted and rotated in the guiding slot 233.

Hereinafter, the operations of the sheet stopping mechanism of the present invention will be illustrated with reference to FIGS. 4A~4C as well as FIG. 2 and FIG. 3. As shown in FIG. 4A, when the automatic document feeder 2 is in a standby status (i.e. before the sheet pick-up roller 21 is used to transport the paper sheet), the stopping part 2311 of the sheet stopping element 231 is contacted with the front edges of the stack of paper sheets P for hindering the paper sheets P from being fed into the sheet-guiding path. At this moment, the protrusion parts 2312 of the sheet stopping element 231 are accommodated within the linear parts 2331 of corresponding guiding slots 233. In a case that a sheet-feeding instruction is received by the automatic document feeder 2, the sheet separating roller 22 is driven to rotate by the driving device. With the axle 221 of the sheet separating roller 22 serving as a rotating shaft, the sheet pick-up arm 25 is rotated such that the sheet pick-up roller 21 is moved downwardly to be close to the sheet input tray 24. In addition, since the transmission gear set 26 is engaged with the first gear 212 and the second gear 222, the sheet pick-up roller 21 is rotated with the sheet separating roller 22. Consequently, as shown in FIG. 4B, the sheet pick-up roller 21 will be in contact with the paper sheets P for successively transporting the paper sheets P.

Please refer to FIG. 2B again. Since the sheathing part 2321 of the guiding element 232 is sheathed around the axle 211 of the sheet pick-up roller 21, the extension arm 2322 of the guiding element 232 will be contacted with the sustaining element 234 during the sheet pick-up roller 21 is moved toward the sheet input tray 24. With the sustaining element 234 serving as a fulcrum, the extension arm 2322 is sustained against the contact part 2314 such that the sheet stopping element 231 is uplifted. During the sheet stopping element 231 is uplifted, the protrusion part 2312 of the sheet stopping element 231 is moved from the linear part 2331 to the curved part 2332 through a connecting point 2333, which is arranged between the linear part 2331 and the curved part 2332. Under this circumstance, the front edges of the paper sheets P are no longer hindered by the stopping part 2311 of the sheet stopping element 231, and thus the uppermost paper sheet P is transported into the entrance of the sheet-guiding path by the sheet pick-up roller 21. As the paper sheets P on the sheet input tray 24 are successively transported into the sheet-guiding path one by one, the sheet pick-up roller 21 is further descended in order to be contacted with the paper sheets S that are remained on the sheet input tray 24. Since the width of the curved part 2332 of the guiding slot 233 is larger than the width of the linear part 2331, the protrusion part 2312 of the sheet stopping element 231 is permitted to be shifted and rotated in the guiding slot 233 to a larger extent. In other words, the sheet stopping element 231 is uplifted to a higher position by the guiding element 232, as is shown in FIG. 4C.

After the sheet-feeding operation is stopped, the sheet pick-up roller 21 is ascended to its original position and thus the guiding element 232 is rotated to its original position. At the same time, the extension arm 2322 of the guiding element 232 is downwardly sustained against the sheet stopping element 231, so that the sheet stopping element 231 is returned to the original position as shown in FIG. 4A. Before a next sheet-feeding operation is activated, the front edges of the paper sheets P that are placed on the sheet input tray will be hindered by the sheet stopping element 231 and fail to be fed into the sheet-guiding path.

From the above description, the sheet stopping mechanism of the present invention is capable of hindering the front edges of the paper sheets when no sheet-feeding instruction is received. Moreover, in response to the sheet-feeding instruction, the sheet stopping element of the sheet stopping mechanism is uplifted in order to allow the paper sheets to be successively transported into the sheet-guiding path. The sheet stopping mechanism of the present invention includes a guiding element, a sheet stopping element and a guiding slot. The guiding element has a first end sheathed around the axle of the sheet pick-up roller and a second end sustained against the sheet stopping element. When the sheet pick-up roller is moved toward the sheet input tray to perform a sheet-feeding operation, the sheet stopping element is shifted and rotated in the guiding slot. As such, the front edge of the paper sheet is no longer hindered by the sheet stopping element but permitted to be transported into a sheet-guiding path. Moreover, since the sheet stopping element is shifted and rotated during the sheet pick-up roller is moved toward the sheet input tray to perform the sheet-feeding operation, the feathering edge resulting from the fabricating process has no adverse influence on the sheet stopping element. Since the sheet stopping element is returned to its original position according to the transmission of the guiding element, the weight of the sheet stopping element does not need to be elaborately designed and controlled. Moreover, since the sheet stopping element could be moved in the upward direction, the possibility of piercing through the paper sheet is avoided when the upper cover is closed.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A sheet stopping mechanism of an automatic document feeder, said automatic document feeder comprising a sheet input tray and a sheet pick-up roller, at least one paper sheet being placed on said sheet input tray, said sheet stopping mechanism comprising:

a guiding element comprising a sheathing part and an extension arm, wherein said sheathing part is sheathed around an axle of said sheet pick-up roller;

a sheet stopping element comprising a stopping part, at least one protrusion part and a contact part, wherein said extension arm of said guiding element is upwardly sustained against at said contact part of said sheet stopping element; and at least one guiding slot for accommodating said at least one protrusion part of said sheet stopping element, wherein said guiding slot is a profiled slot comprising a linear part and a curved part;

wherein when said sheet pick-up roller is moved toward said sheet input tray, said guiding element is uplifted through the transmission of said sheathing part and said sheet pick-up roller, so that said protrusion part of said sheet stopping element is shifted and rotated in said guiding slot, and a front edge of said paper sheet is no longer hindered by said stopping part of said sheet stopping element but permitted to be transported into a sheet-guiding path.

2. The sheet stopping mechanism according to claim 1 wherein said guiding element further includes a confining part, which is formed at an end of said extension arm for preventing said contact part from being detached from said extension arm.

3. The sheet stopping mechanism according to claim 1 wherein said stopping part of said sheet stopping element is disposed at a lower end of said sheet stopping element.

4. The sheet stopping mechanism according to claim 1 wherein said at least one protrusion part includes two protrusion parts, said at least one guiding slot includes two guiding slots, and said protrusion parts are symmetrically arranged on bilateral sides of the sheet stopping element and inserted into corresponding guiding slots.

5. The sheet stopping mechanism according to claim 1 wherein said sheet stopping element further includes a perforation near an upper end of said sheet stopping element, said contact part of said sheet stopping element is a horizontal rod arranged at said upper end of said sheet stopping element, and said extension arm of said guiding element penetrates through said perforation.

6. The sheet stopping mechanism according to claim 1 wherein said automatic document feeder further includes an upper cover, multiple partition plates are protruded from an inner surface of said upper cover, and said sheet stopping element is arranged between two adjacent partition plates.

7. The sheet stopping mechanism according to claim 6 wherein said sheet stopping mechanism further includes a sustaining element, and said sustaining element includes two slabs, which are extended from said two adjacent partition plates and face each other.

8. The sheet stopping mechanism according to claim 7 wherein when said sheet pick-up roller is moved toward said sheet input tray, said extension arm of said guiding element is contacted with said sustaining element, and said extension arm is sustained against said contact part with said sustaining element serving as a fulcrum, so that said sheet stopping element is uplifted.

9. The sheet stopping mechanism according to claim 6 wherein said at least one guiding slot includes two guiding slots, which are respectively formed in said two adjacent partition plates.

10. The sheet stopping mechanism according to claim 1 wherein said linear part is substantially perpendicular to a horizontal plane, wherein the width of said linear part is slightly larger than the width of said protrusion part of the said stopping element; and said curved part is in communication with said linear part and bent toward said sheet pick-up roller, wherein the width of said curved part is larger than the width of said linear part such that said protrusion part of said sheet stopping element is permitted to be shifted and rotated in said guiding slot.

11. An automatic document feeder comprising:

a sheet input tray for placing thereon at least one paper sheet;

a sheet pick-up roller for transporting said paper sheet that is placed on said sheet input tray; and a sheet stopping mechanism for selectively hindering said paper sheet from being transported into a sheet-guiding path or allowing said paper sheet to be transported into said sheet-guiding path by said sheet pick-up roller, and said sheet stopping mechanism comprising:

a guiding element comprising a sheathing part and an extension arm, wherein said sheathing part is sheathed around an axle of said sheet pick-up roller;

a sheet stopping element comprising a stopping part, at least one protrusion part and a contact part, wherein said extension arm of said guiding element is upwardly sustained against at said contact part of said sheet stopping element; and at least one guiding slot for accommodating said at least one protrusion part of said sheet stopping element, wherein said guiding slot is a profiled slot comprising a linear part and a curved part;

wherein when said sheet pick-up roller is moved toward said sheet input tray, said guiding element is uplifted through the transmission of said sheathing part and said sheet pick-up roller, so that said protrusion part of said sheet stopping element is shifted and rotated in said guiding slot, and a front edge of said paper sheet is no longer hindered by said stopping part of said sheet stopping element but permitted to be transported into said sheet-guiding path.

12. The automatic document feeder according to claim 11 wherein said guiding element further includes a confining part, which is formed at an end of said extension arm for preventing said contact part from being detached from said extension arm.

13. The automatic document feeder according to claim 11 wherein said stopping part of said sheet stopping element is disposed at a lower end of said sheet stopping element.

14. The automatic document feeder according to claim 11 wherein said at least one protrusion part includes two protrusion parts, said at least one guiding slot includes two guiding slots, and said protrusion parts are symmetrically arranged on bilateral sides of the sheet stopping element and inserted into corresponding guiding slots.

15. The automatic document feeder according to claim 11 wherein said sheet stopping element further includes a perforation near an upper end of said sheet stopping element, said contact part of said sheet stopping element is a horizontal rod arranged at said upper end of said sheet stopping element, and said extension arm of said guiding element penetrates through said perforation.

16. The automatic document feeder according to claim 11 wherein said automatic document feeder further includes an upper cover, multiple partition plates are protruded from an inner surface of said upper cover, and said sheet stopping element is arranged between two adjacent partition plates.

17. The automatic document feeder according to claim 16 wherein said automatic document feeder further includes a sustaining element, and said sustaining element includes two slabs, which are extended from said two adjacent partition plates and face each other.

18. The automatic document feeder according to claim 17 wherein when said sheet pick-up roller is moved toward said sheet input tray, said extension arm of said guiding element is contacted with said sustaining element, and said extension arm is sustained against said contact part with said sustaining element serving as a fulcrum, so that said sheet stopping element is uplifted.

19. The automatic document feeder according to claim 16 wherein said at least one guiding slot includes two guiding slots, which are respectively formed in said two adjacent partition plates.

20. The sheet stopping mechanism according to claim 1 wherein said linear part is substantially perpendicular to a horizontal plane, wherein the width of said linear part is slightly larger than the width of said protrusion part of the said stopping element; and said curved part is in communication with said linear part and bent toward said sheet pick-up roller, wherein the width of said curved part is larger than the width of said linear part such that said protrusion part of said sheet stopping element is permitted to be shifted and rotated in said guiding slot.

* * * * *